US010384918B2

(12) United States Patent
Nagge et al.

(10) Patent No.: US 10,384,918 B2
(45) Date of Patent: Aug. 20, 2019

(54) APPARATUS AND METHOD TO MOVE A PRESSURE VESSEL BETWEEN HORIZONTAL AND VERTICAL POSITIONS

(71) Applicant: DYNACORP FABRICATORS INC., Calgary (CA)

(72) Inventors: Rory Nagge, Calgary (CA); Jeffrey Gar Sing Chan, Calgary (CA)

(73) Assignee: ENERCORP SAND SOLUTIONS INC., Calgary, Alberta (CA)

( * ) Notice: Subject to any disclaimer, the term of this patent is extended or adjusted under 35 U.S.C. 154(b) by 0 days.

(21) Appl. No.: 15/795,985

(22) Filed: Oct. 27, 2017

(65) Prior Publication Data

US 2018/0118536 A1 May 3, 2018

Related U.S. Application Data

(60) Provisional application No. 62/415,082, filed on Oct. 31, 2016.

(51) Int. Cl.
*B66F 3/24* (2006.01)
*F17C 13/08* (2006.01)

(52) U.S. Cl.
CPC ..... *B66F 3/24* (2013.01); *F17C 13/08* (2013.01); *F17C 2205/0107* (2013.01)

(58) Field of Classification Search
CPC .... B60P 1/6427; B60P 1/6463; B65D 88/128; B65D 88/30; B65D 88/56
USPC ..... 414/332
See application file for complete search history.

(56) References Cited

U.S. PATENT DOCUMENTS 3,208,616 A * 9/1965 Haskins ..... B65D 88/30 414/332
3,938,673 A * 2/1976 Perry, Jr. ..... B28C 7/049 414/21
4,561,821 A * 12/1985 Dillman ..... B65D 88/30 414/332
4,626,166 A * 12/1986 Jolly ..... B60P 1/64 298/19 R
4,634,335 A * 1/1987 van den Pol ..... B60P 1/64 414/494
4,708,569 A * 11/1987 Nijenhuis ..... B60P 1/64 414/332
4,775,275 A * 10/1988 Perry ..... B28C 7/0495 366/18
6,474,926 B2 * 11/2002 Weiss ..... B28C 7/0495 414/332
8,926,252 B2 * 1/2015 McIver ..... B60P 1/6427 414/332
9,428,094 B2 * 8/2016 Herman ..... B60P 1/6427
2003/0202869 A1 * 10/2003 Posch ..... B60P 1/6418 414/498
2005/0260062 A1 * 11/2005 Boasso ..... B28C 7/0084 414/332
2007/0207017 A1 * 9/2007 Boasso ..... B28C 7/0084 414/434

(Continued)

*Primary Examiner* — Kaitlin S Joerger
(74) *Attorney, Agent, or Firm* — MH2 Technology Law Group LLP

(57) ABSTRACT

An assembly for adjusting a position of a vessel includes a frame for carrying the vessel, and a lifting device configured to move the frame from a horizontal position to a first vertical position by pivoting the frame, and to move the frame from the first vertical position to a second vertical position by raising the frame.

16 Claims, 5 Drawing Sheets

(56) References Cited

U.S. PATENT DOCUMENTS

| | | | | |
|---|---|---|---|---|
| 2012/0134772 | A1* | 5/2012 | Herman | B60P 1/6463 414/808 |
| 2014/0050553 | A1* | 2/2014 | Raney | B65G 1/02 414/332 |
| 2015/0044003 | A1* | 2/2015 | Pham | B65D 88/32 414/332 |
| 2015/0044004 | A1* | 2/2015 | Pham | B65D 88/32 414/332 |
| 2016/0362035 | A1* | 12/2016 | Cain | B65G 67/04 |
| 2017/0021318 | A1* | 1/2017 | McIver | B01F 15/0479 |

* cited by examiner

APPARATUS AND METHOD TO MOVE A PRESSURE VESSEL BETWEEN HORIZONTAL AND VERTICAL POSITIONS

CROSS-REFERENCE TO RELATED APPLICATIONS

This application claims priority to U.S. Provisional Patent Application No. 62/415,082, which was filed on Oct. 31, 2016.

FIELD

The present disclosure relates to apparatus and methods to move a pressure vessel between operable horizontal and vertical positions.

BACKGROUND

Pressure vessels having an inlet and outlet have been used for a variety of purposes. Many of these pressure vessels are operated either in a vertical position or a horizontal position. In the vertical position, the axis of the pressure vessel is orientated generally vertically with respect to ground level, and in the horizontal position, the axis of the pressure vessel is generally disposed horizontally with respect to ground level.

In the oil and gas industry, pressure vessels are sometimes used to separate sand or other solids from fluids such as hydrocarbons produced from a wellhead. In some cases, the pressure vessels are operated in the vertical position and, in others, they are operated in the horizontal position.

Furthermore, such pressure vessels used in the oil and gas industry are typically transported to be erected at the well site, and thus employ various assemblies used to facilitate such transport and erection. For example, one design that has been employed utilizes a mobile rig having a rig transporter comprising a motorized unit, a masked assembly, a pivotal connection to the mass assembly with respect to the rig transporter. At least one hydraulic arm is pivotally mounted to the rig transporter and the masked assembly operable to move the masked to an upright position and for lowering the masked to a substantially horizontal position for transportation.

SUMMARY

Embodiments of the disclosure may provide an assembly for adjusting a position of a vessel. The assembly includes a frame for carrying the vessel, and a lifting device configured to move the frame from a horizontal position to a first vertical position by pivoting the frame, and to move the frame from the first vertical position to a second vertical position by raising the frame.

Embodiments of the disclosure may also provide a pressure vessel assembly. The pressure vessel assembly may include a pressure vessel, a frame coupled to the pressure vessel, such that the pressure vessel is movable by moving the frame, a skid plate pivotally coupled to the frame, and a lifting device coupled to the frame and the skid plate. The lifting device is configured to pivot the frame, with respect to the skid plate, from a horizontal position to a first vertical position, and to raise the frame vertically from the first vertical position to a second vertical position.

Embodiments of the disclosure may further provide a method for operating a pressure vessel. The method includes pivoting a frame from a horizontal position to a first vertical position using a lifting device coupled to a skid. At least an end of the pressure vessel is positioned in the frame, and the pressure vessel is movable by moving the frame. The method also includes raising the frame from the first vertical position to a second vertical position using the lifting device.

The foregoing summary is intended merely to introduce a subset of the features of the disclosure that will be discussed in greater detail below. This summary should not be considered as identifying key features or otherwise limiting the scope of the disclosure.

DETAILED DESCRIPTION

Figure 3:
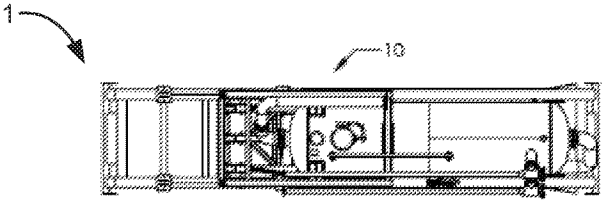
FIG. 3 is a top plan view of FIG. 1, according to an embodiment.
Figure 4:
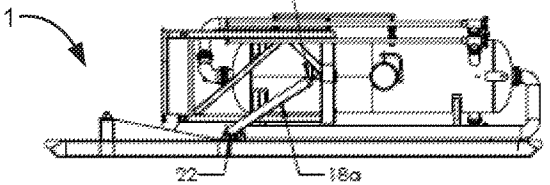
FIG. 4 is a side elevation view of FIG. 1, according to an embodiment.
Figure 2:
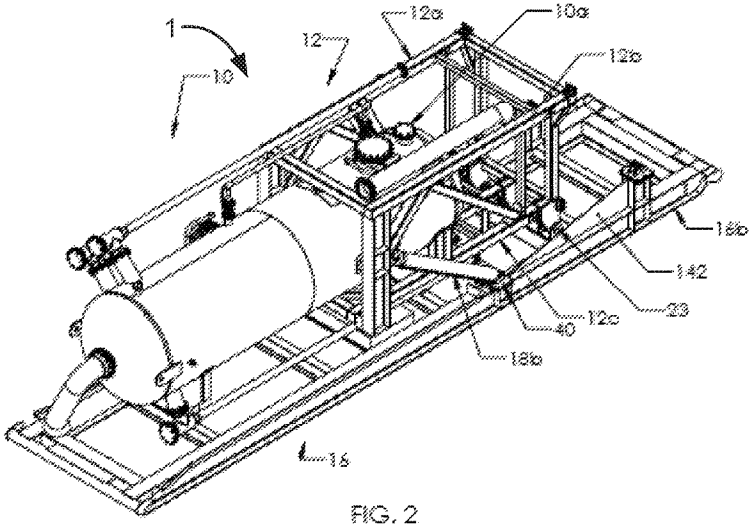
FIG. 2 is another perspective view taken from above and the other side of the vessel in a horizontal position, according to an embodiment.
Figure 1:
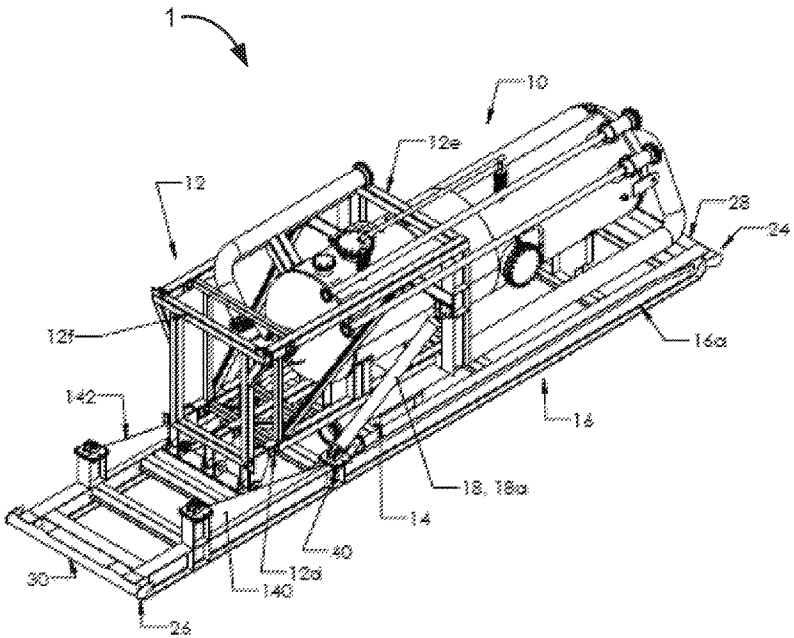
FIG. 1 is a perspective view taken from above and one side of the vessel in a horizontal position, according to an embodiment.

A detailed description of one or more embodiments of the disclosure is provided below along with accompanying figures that illustrate the principles of the disclosure.

FIGS. 1-4 illustrates views of a pressure vessel assembly 1 in a horizontal configuration, according to an embodiment. In particular, the assembly 1 includes pressure vessel 10 that is positioned such that its longitudinal axis is parallel to the ground, i.e., in a horizontal position. The assembly 1 further includes a skid 16, a frame 12 in a horizontal position and pivotally coupled to the skid 16, and a lifting device 14 that may be actuated to adjust the orientation and/or the vertical position of the frame 12 relative to the skid 16 and the ground.

The vessel 10 may be positioned at least partially in and secured to the frame 12, such that the vessel 10 is movable with the frame 12. In turn, the frame 12 carries the weight of the vessel 10 and transfers the weight to the skid 16 and ultimately to the ground. In an embodiment, the frame 12 may be a generally box-shaped structure, but in other embodiments, could be any suitable shape. In an embodiment, the frame 12 may have generally linear corner members 12A, 12B, 12C and 12D, which, in the horizontal position, extend horizontally. The frame 12 may also include generally square-shaped end members 12E, 12F. The plane defined by the end members 12E, 12F may extend generally vertically when the assembly 1 is in the horizontal configuration.

In an embodiment, the skid 16 may be formed as a generally rectangular structure. Thus, for example, the skid 16 may include longitudinal skid members 16A and 16B extending generally parallel to one another. The skid 16 also includes transverse skid members 28 and 30 that extend between and are connected to the skid members 16A, 16B. For example, one of the transverse skid members 28 may be positioned at first end 24 of the skid 16, while the other transverse skid member 30 is positioned at the opposite end 26 of the skid 16. In other embodiments, the transverse skid members 28, 30 may be positioned at acute angles to the longitudinal skid members 16A, 16B, or may be offset from the ends 24, 26.

The skid 16 may provide two or more connection points 40, 50 for connection to the lifting device 14. The connection points 40, 50 may be provided, for example, by hinges or brackets, as shown, which may receive a clevis of a hydraulic cylinder, or any other suitable device. In the example of a clevis, a pin may be received through the hinge, providing a pivotal connection between the cylinder and the skid 16. In an embodiment, the first and second connection points 40, 50, may be horizontally (e.g., longitudinally) offset from one another. For example, the first and second connection points 40, 50 may be connected to one of the longitudinal skid members 16A, 16B and offset from one another in the horizontal (e.g., longitudinal) direction. Further, the first and second connection points 40, 50 may be vertically offset from one another, e.g., the second connection point 50 may be elevated higher from the ground than the first connection point 40.

Figure 10:
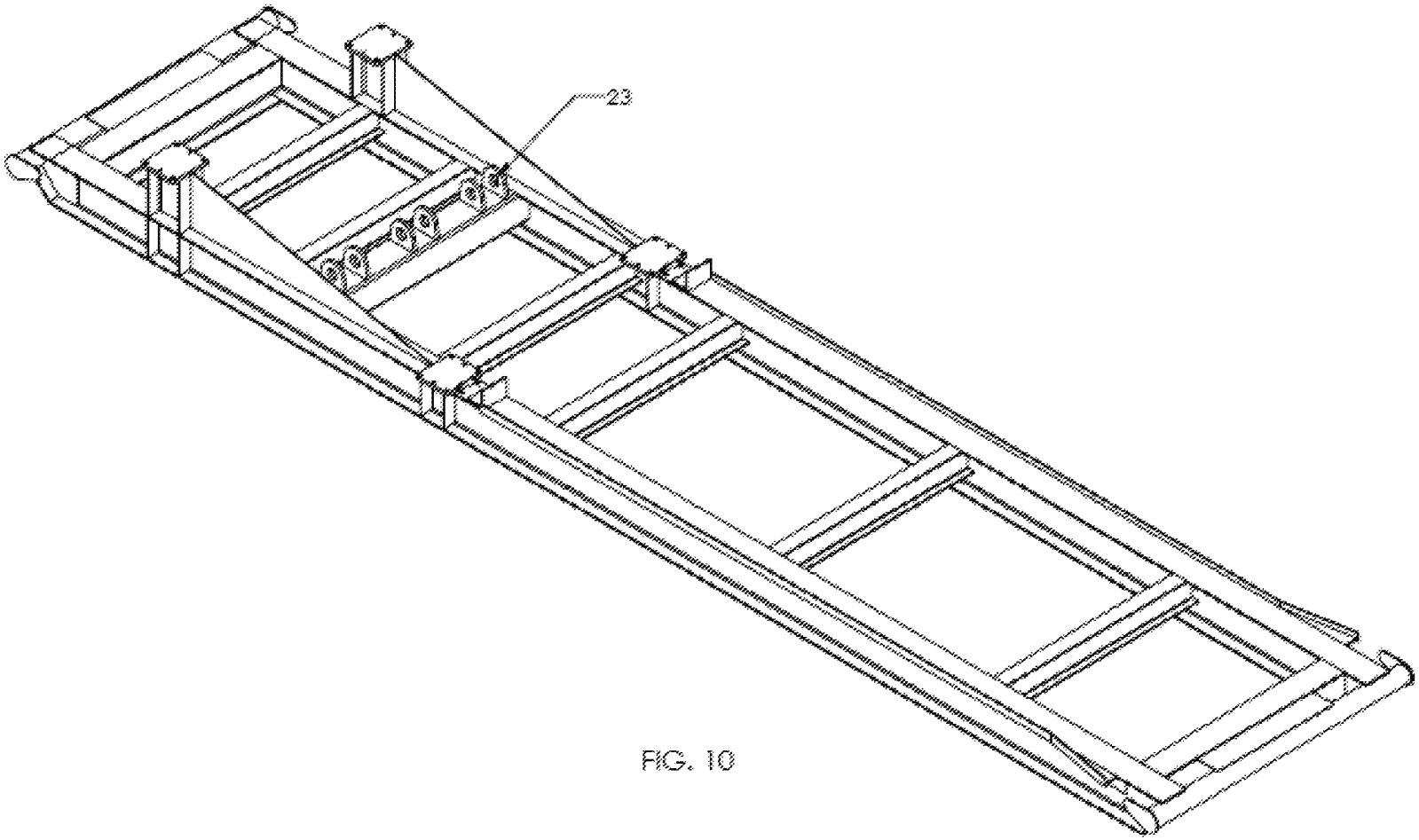
FIG. 10 is a perspective view of the skid assembly, according to an embodiment.

The skid 16 may further include one or more pivot points 23 where the frame 12 may be pivotally coupled to the skid 16. The pivot points 23 may be provided by hinges or brackets, as shown. For example, a corner of the frame 12 may be coupled to the skid 16 at the pivot point 23 and thus two or more such pivot points 23 may be provided, allowing for pivoting movement to be effected by actuating the lifting device 14, as will be described in greater detail below. In an embodiment, the pivot point(s) 23 may be horizontally (e.g., longitudinally) between the first and second connection points 40, 50, as shown. FIG. 10 illustrates another view of the skid 16 showing an arrangement of three pivot points 23.

The assembly 1 may also include a lifting device 14 for moving the frame 12 carrying the vessel 10, relative to the skid 16. The lifting device 14 may include any mechanical, electro-mechanical, pneumatic, or hydraulic devices capable of displacing the frame 12 and the vessel 10 with respect to the skid 16 as described herein. As a specific example, the lifting device 14 may include an extendible arm, which, as illustrated, may be provided by one or more hydraulic cylinders (two shown: 18A, 18B). The hydraulic cylinders 18A, 18B may be mounted on either or both sides of the frame 12, as shown.

In particular, the first end 20 of each of the hydraulic cylinders 18A, 18B may be connected to the first end member 12E of the frame 12. The second end member 12F of the frame 12 is pivotally connected at pivot points 23 to the longitudinal skid members 16A, 16B between the end skid members 28, 30. A second end 22 of the hydraulic cylinder 18A, 18B is connected to the longitudinal skid members 16A, 16B at the first connection point 40, between the transverse skid members 28, 30. Accordingly, extension of the extendible arm (e.g., hydraulic cylinders 18A, 18B) causes the frame 12 and thus the vessel 10 to pivot with respect to the skid 16 from the horizontal position, through an arc, to an upright, first vertical position.

Figure 6:
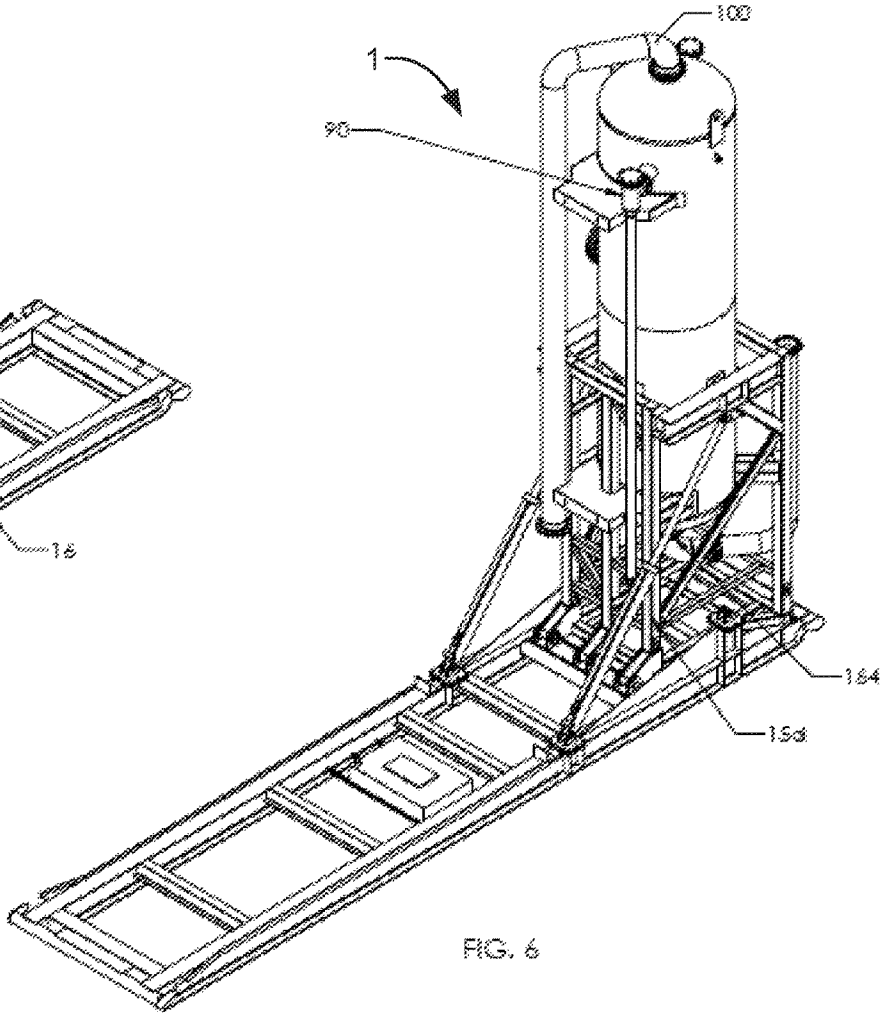
FIG. 6 is a perspective view taken from the top and the other side of the vessel in a vertical position, according to an embodiment.
Figure 5:
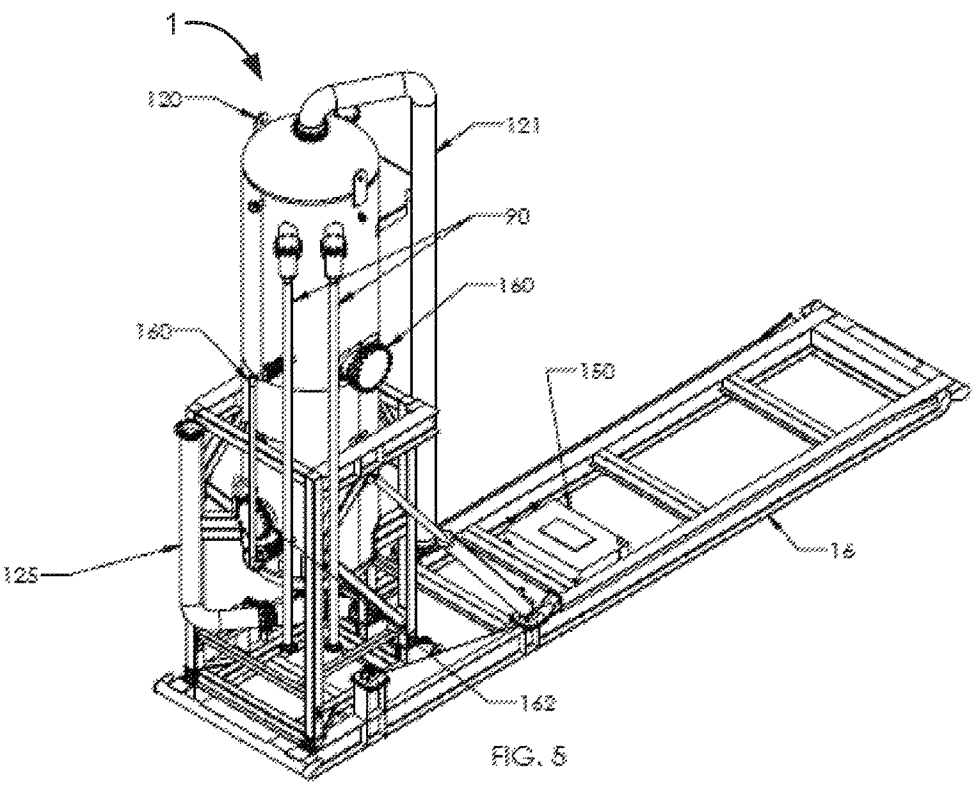
FIG. 5 is a perspective view taken from the top and one side of the vessel in a vertical position, according to an embodiment.

FIGS. 5 and 6 illustrate perspective views of the assembly 1 in a first vertical configuration, according to an embodiment. As shown, the lifting device 14 has been actuated, e.g., by extending the cylinders 18A, 18B. Accordingly, the frame 12 has been pivoted with respect to the skid 16, through an arc, until the corners thereof that are not pivotally connected to the skid 16 and the pivot point(s) 23 land on the skid 16, as shown. Thus, the vessel 10 and the frame 12 are in the first vertical position.

As can be seen in the upright view of FIG. 5, the vessel 10 may include one or more lugs 120 to assist in tethering the vessel 10, e.g., using a stabilizing line, cable, or another structure. The lugs 120 may be used to stabilize the vessel 10 in the vertical position so as to permit the other end 22 of the hydraulic cylinders 18A, 18B to be disconnected from the longitudinal skid members 16A, 16B at the first connection point 40, as will be explained in greater detail below. The lugs 120 may also be used to stabilize the final positioning of the vessel 10 for subsequent operation.

The assembly 1 may also optionally include a hydraulic fluid reservoir 150 so as to provide a self-contained unit for the lifting device 14. Further, the assembly 1 may include a magnetic level gage 160 for the vessel 10. In addition, the pressure vessel 10 may have an inlet diffuser so as to assist in the diffusion of the sand mixed with the hydraulic fluid liquid as it enters the inner chamber of the vessel 10. Moreover the embodiment as shown in the Figures illustrates the use of two baffle plates 110 oriented at an angle relative to one another.

Figure 8:
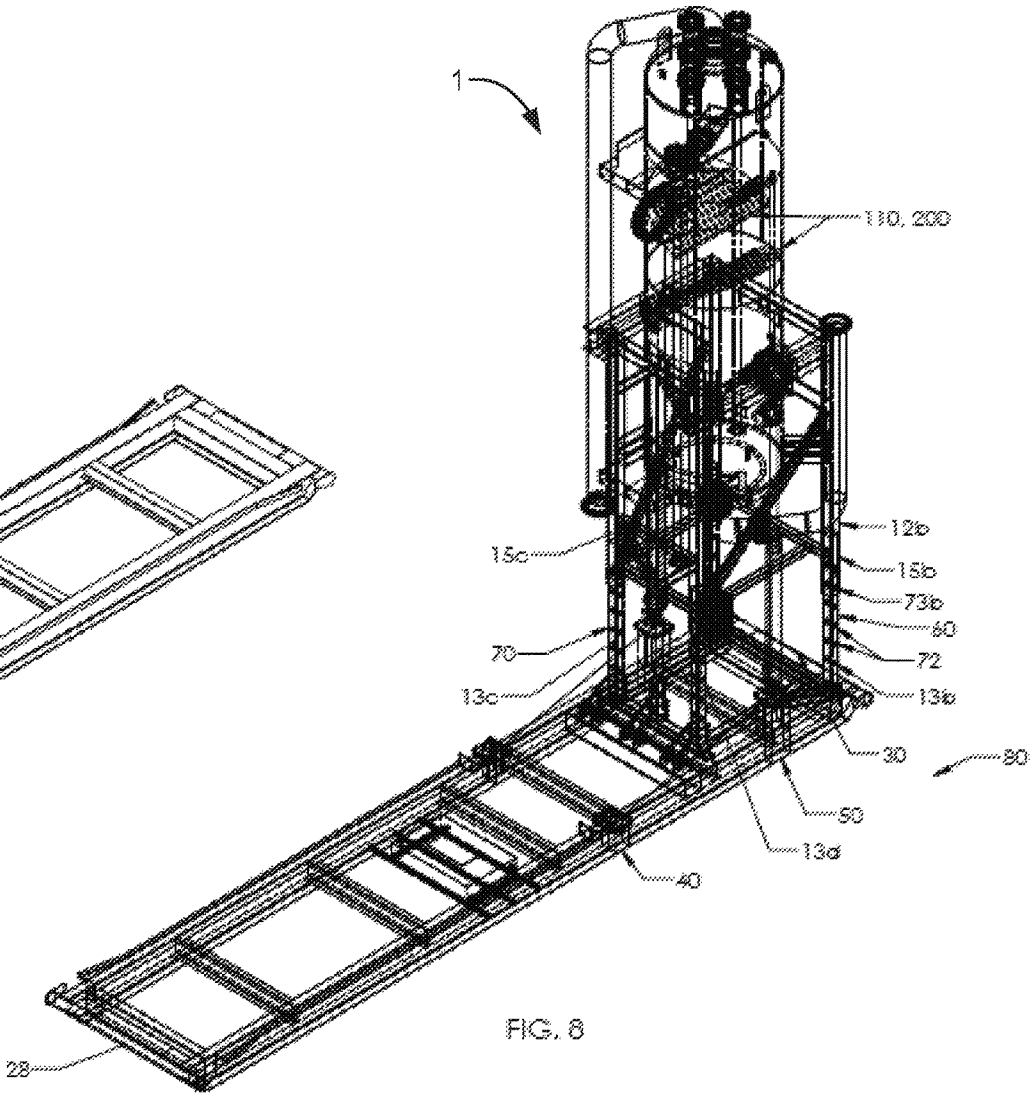
FIG. 8 is a perspective view similar to FIG. 6 but in a second vertical position, according to an embodiment.
Figure 7:
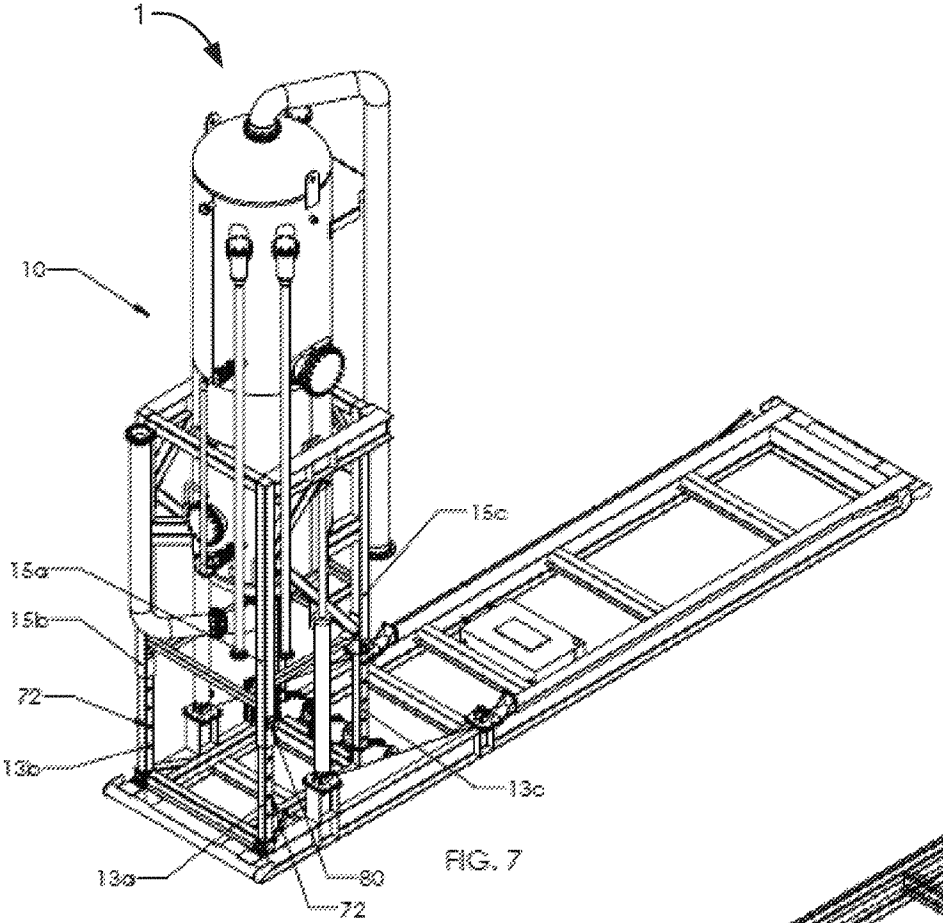
FIG. 7 is a perspective view similar to FIG. 5 but in a second vertical position, according to an embodiment.

FIGS. 7 and 8 illustrate views of the assembly 1 in a second vertical configuration, according to an embodiment. As shown, the hydraulic cylinders 18A, 18B have been disconnected from the first connection point 40, connected to the second connection point 50, and extended, thereby raising the frame 12 and thus the vessel 10 vertically, with respect to the skid 16. In other embodiments, the lifting assembly 14 may include two sets of hydraulic cylinders (or other types of extendible arms), one set coupled to each of the connection points 40, 50, such that disconnecting and reconnecting of a single set of hydraulic cylinders may be omitted.

In an embodiment, the frame 12 may include an extendible base 60, e.g., provided by extendible "legs" of the corner frame members 12A, 12B, 12C, 12D. For example, an inner corner frame member 13A, 13B, 13C and 13D may be positioned within and slidable with respect to an outer corner frame member 15A, 15B, 15C and 15D, so as to define each of the extendible legs. Position-locking devices 70 may be provided for locking the extendible legs in an extended position, e.g., at a plurality of selected vertical positions between the first vertical position shown in FIGS. 5 and 6 and the second vertical position shown in FIGS. 7 and 8. For example, a plurality of holes 72 may be defined in the inner corner frame members 13A, 13B, 13C and 13D, which may be alignable with one or more holes 73B presented by the outer corner frame members 15A, 15B, 15C, and 15D respectively. As such, the holes 72, 73B may be aligned to receive a pin 80 and thereby restrain members from sliding with respect to one another.

Figure 9:
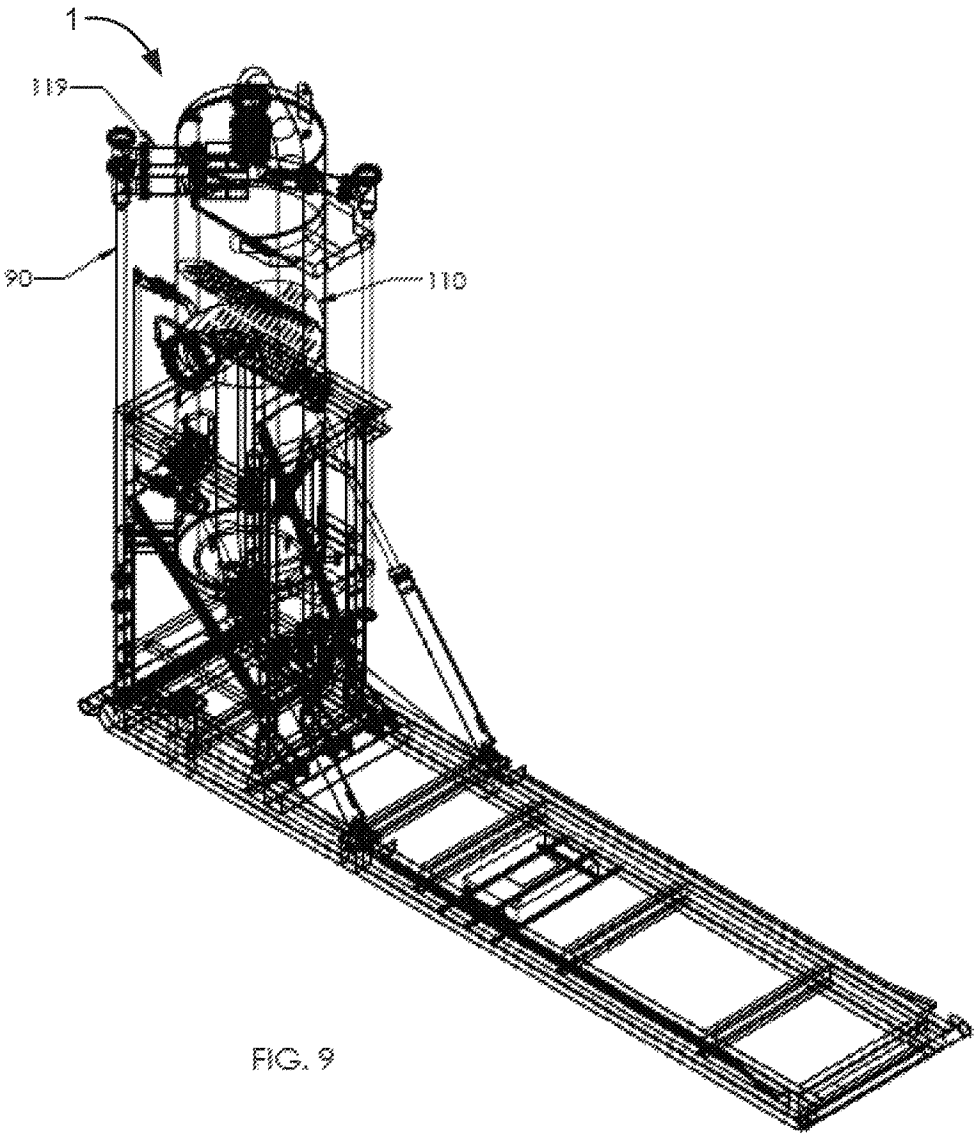
FIG. 9 is a perspective view similar to FIG. 7 but rotated 90 degrees which illustrates the demister, according to an embodiment.

As is also visible in FIG. 8, as well as in FIG. 9, the vessel 10 may include an inlet 90 and an outlet 100 and at least one baffle 110 disposed in the vessel 10. The baffle 110 may be disposed at an angle relative to the horizontal or vertical positions between the inlet 90 and outlet 100 for separating sand or other solids from fluids, such as hydraulic fluids, when the vessel is in the horizontal or vertical position. In one embodiment, the baffle plates 200 are disposed at about a 60 degree angle relative to the longitudinal axis of the vessel 10. The baffle plates 200 have a plurality of slots so as to assist in the separation of sand from the hydraulic fluid.

The pressure vessel 10 can be transported from one location to another, and depending on the orientation of the wellhead, the pressure vessel can be operated in the horizontal position or in the vertical position. Also depending on the orientation of the wellhead, the pressure vessel in the vertical position can be adjusted in height relative to the ground level so as to facilitate connection to the equipment at the wellhead.

The present disclosure includes a method of operating a vessel 10 in a horizontal or vertical position. The method includes placing one end 10A of the vessel 10 in a frame 12 mounted on a skid 16 in a horizontal position wherein the vessel 10 has an inlet 90 and an outlet 100 and at least one baffle 110 disposed in the vessel 10 at an angle relative to the horizontal position, said baffle 110 disposed between the inlet 90 and outlet 100. The method also includes selecting to operate the vessel 10 in a vertical position by moving the frame 12 and vessel 10 relative the skid 16 from the horizontal position to the vertical position by actuating a lifting device 14, e.g., extending hydraulic cylinders 18A, 18B connected to the skid 16 and frame 12 between the inlet 90 and outlet 100.

The frame 12 and vessel 10 are both pivotally moved about a pivot point 23 relative to the skid 16 from the horizontal to the vertical positions. The frame 12 and vessel 10 are selectively moved in the vertical position by the hydraulic cylinders 18A, 18B between a first vertical position as shown in FIGS. 5 and 6 and a second vertical position as shown in FIGS. 7 and 8.

The method also includes connecting one end 20 of the hydraulic cylinders 18A, 18B to the frame 12 and connecting another end 22 of the hydraulic cylinders 18A, 18B to a first position on the skid 16 for moving the vessel 10 from the horizontal to vertical position, and to a second position on the skid 16 for displacing the vessel 10 in the vertical position between a first vertical position and a second vertical position.

Embodiments of the disclosure may also provide a method for operating a pressure vessel, such as pressure vessel 10. The method may include pivoting a frame 12 from a horizontal position to a first vertical position using a lifting device 14 coupled to a skid 16. At least an end of the pressure vessel 10 may be positioned in the frame 12, and the pressure vessel 10 may be movable by moving the frame 12. The method may also include raising the frame 12 from the first vertical position to a second vertical position using the lifting device 14.

In an embodiment, pivoting the frame 12 may include extending an extendible arm (e.g., hydraulic cylinders 18A, 18B) connected to a first connection point 40 of the skid 16. Further, raising the frame 12 may include extending the extendible arm. In an embodiment, the extendible arm is connected to a second connection point 50 of the skid that is offset form the first connection point 40 (e.g., horizontally, vertically, or both). In an embodiment, the method also includes disconnecting the extendible arm from the first connection point 40 after pivoting the frame 12, and connecting the extendible arm to the second connection point 50 before raising the frame 12.

In an embodiment, raising the frame 12 causes legs (e.g., lower ends of the frame members 12A, 12B, 12C, 12D) of the frame 12 to extend to an extended position. In such an embodiment, the method may include locking the legs in the extended position.

In some embodiments, the pressure vessel 10 includes an inlet 90, an outlet 100, and at least one baffle 110 disposed therein, between the inlet 90 and the outlet 100, at a non-zero angle relative to the horizontal position.

In general, in the following claims, the terms used should not be construed to limit the invention to the specific embodiments disclosed in the specification and the claims, but should be construed to include all possible embodiments along with the full scope of embodiments to which such claims are entitled. Accordingly the invention is not limited by the disclosure, but instead its scope is to be determined by the following claims.

What is claimed is:

1. An assembly for adjusting a position of a vessel, the assembly comprising:

a frame for carrying the vessel;

a lifting device configured to move the frame from a horizontal position to a first vertical position by pivoting the frame, and to move the frame from the first vertical position to a second vertical position by raising the frame, wherein the lifting device comprises an extendible arm comprising a first end and a second end, the first end being coupled to the frame; and a skid pivotally coupled to the frame and coupled to the lifting device, wherein the skid comprises a first connection point and a second connection point, wherein, when the frame is in the horizontal position and when the frame is in the first vertical position, the second end is connected to the first connection point of the skid, such that extending the extendible arm causes the frame to pivot with respect to the skid, and wherein, when the frame is in the first vertical position, the second end is connected to the second connection point of the skid, such that extending the extendable arm raises the frame vertically.

2. The assembly of claim 1, wherein the skid comprises longitudinal skid members, the first connection point and the second connection point being offset along one of the longitudinal skid members.

3. The assembly of claim 1, wherein the frame comprises extendible legs that are extended when the frame is moved from the first vertical position to the second vertical position.

4. The assembly of claim 3, further comprising one or more locking members configured to lock a position of the extendible legs, so as to maintain the frame in the second vertical position.

5. The assembly of claim 1, wherein the extendible arm comprises one or more hydraulic cylinders.

6. The assembly of claim 1, further comprising one or more lugs coupled to the vessel, the frame, or both, wherein the one or more lugs are configured to be connected to a tethering line to restrain the frame, the vessel, or both from moving.

7. An assembly for adjusting a position of a vessel, the assembly comprising:

a frame for carrying the vessel;

a lifting device configured to move the frame from a horizontal position to a first vertical position by pivoting the frame, and to move the frame from the first vertical position to a second vertical position by raising the frame, wherein the lifting device comprises an extendible arm comprising a first end and a second end, the first end being coupled to the frame; and a skid pivotally coupled to the frame and coupled to the lifting device, wherein the skid comprises a first connection point and a second connection point, wherein the skid comprises longitudinal skid members, the first connection point and the second connection point being offset along one of the longitudinal skid members, wherein, when the frame is in the horizontal position and when the frame is in the first vertical position, the second end is connected to the first connection point of the skid, such that extending the extendible arm causes the frame to pivot with respect to the skid, and wherein the first connection point and the second connection point are offset vertically from one another.

8. An assembly for adjusting a position of a vessel, the assembly comprising:

a frame for carrying the vessel;

a lifting device configured to move the frame from a horizontal position to a first vertical position by pivoting the frame, and to move the frame from the first vertical position to a second vertical position by raising the frame, wherein the lifting device comprises an extendible arm comprising a first end and a second end, the first end being coupled to the frame; and a skid pivotally coupled to the frame and coupled to the lifting device, wherein the skid comprises a first connection point and a second connection point, wherein, when the frame is in the horizontal position and when the frame is in the first vertical position, the second end is connected to the first connection point of the skid, such that extending the extendible arm causes the frame to pivot with respect to the skid, and wherein the frame is connected to the skid at a pivot point that is longitudinally between the first and second connection points.

9. A pressure vessel assembly, comprising:

a pressure vessel;

a frame coupled to the pressure vessel, such that the pressure vessel is movable by moving the frame;

a skid plate pivotally coupled to the frame, wherein the skid plate comprises a first connection point and a second connection point that is horizontally offset from the first connection point; and a lifting device coupled to the frame and the skid plate, wherein the lifting device is configured to pivot the frame, with respect to the skid plate, from a horizontal position to a first vertical position, and to raise the frame vertically from the first vertical position to a second vertical position, wherein the lifting device comprises at least one extendible arm that is connectable to the first and second connection points, wherein, when the at least one extendable arm is connected to the first connection point, extending the at least one extendable arm causes the frame to pivot with respect to the skid plate toward the first vertical position, and wherein, when the at least one extendable arm is connected to the second connection point, extending the at least one extendable arm moves the frame from the first vertical position to the second vertical position.

10. The pressure vessel of claim 9, wherein the skid plate further comprises a pivot point positioned horizontally between the first and second connection points, the frame being coupled to the skid plate at the pivot point.

11. The pressure vessel assembly of claim 9, wherein the frame comprises extendible legs, wherein the extendible legs are configured to be locked in an extended position to maintain the frame in the second vertical position.

12. The pressure vessel assembly of claim 9, wherein the pressure vessel comprises an inlet, an outlet, and a baffle positioned within the pressure vessel between the inlet and the outlet, the inlet being positioned within the frame and the outlet being positioned above the frame at least when the frame is in the first vertical position.

13. A method for operating a pressure vessel, comprising:

pivoting a frame from a horizontal position to a first vertical position using a lifting device coupled to a skid, wherein at least an end of the pressure vessel is positioned in the frame, and wherein the pressure vessel is movable by moving the frame, wherein pivoting the frame comprises extending an extendible arm of the lifting device, the extendible arm being connected to a first connection point of the skid; and raising the frame from the first vertical position to a second vertical position using the lifting device, wherein raising the frame comprises extending the extendible arm, wherein the extendible arm is connected to a second connection point of the skid that is offset form the first connection point.

14. The method of claim 13, further comprising:

disconnecting the extendible arm from the first connection point after pivoting the frame; and connecting the extendible arm to the second connection point before raising the frame.

15. The method of claim 13, wherein raising the frame causes legs of the frame to extend to an extended position, the method further comprising locking the legs in the extended position.

16. The method of claim 13, wherein the pressure vessel includes an inlet, an outlet, and at least one baffle disposed therein, between the inlet and the outlet, at a non-zero angle relative to the horizontal position.

* * * * *